United States Patent [19]

Ward

[11] Patent Number: 4,747,491

[45] Date of Patent: May 31, 1988

[54] TAB-OPENING CONTAINER

[75] Inventor: Thomas F. Ward, Madison, Wis.

[73] Assignee: Rayovac Corporation, Madison, Wis.

[21] Appl. No.: 870,111

[22] Filed: Jun. 3, 1986

[51] Int. Cl.[4] ..... B65D 65/26

[52] U.S. Cl. ..... 206/633; 206/628; 206/432; 206/497

[58] Field of Search ..... 206/628, 604, 601, 605, 206/606, 613, 623, 627, 631, 633, 432, 434, 497; 229/87 R, 87 S

[56] References Cited

U.S. PATENT DOCUMENTS

| | | | |
|---|---|---|---|
| 1,987,596 | 1/1935 | Cox | 206/604 |
| 3,259,507 | 7/1966 | Smith | 206/633 |
| 3,497,131 | 2/1970 | Tracy | 206/606 |
| 3,731,792 | 5/1973 | Rolston | 206/497 |

*Primary Examiner*—Willis Little

*Attorney, Agent, or Firm*—Kenyon & Kenyon

[57] ABSTRACT

An easily accessible container is disclosed having a wrapping material wrapped around products or product holders and further having a pull tab for ease of removing the material. The pull tab may further act to bind ends of the wrapping material prior to removal of the material by consumers.

4 Claims, 2 Drawing Sheets

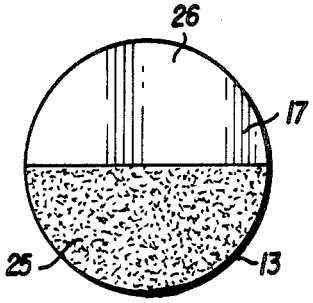
FIG. 2
FIG. 3
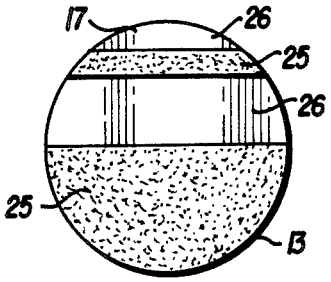
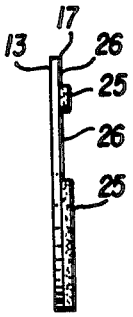
FIG. 4
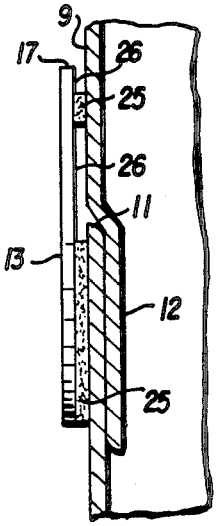
FIG. 5

TAB-OPENING CONTAINER

The invention relates to containers providing easy access to products or product holders which are wrapped in packing films, wraps or the like. The use of plastic and other materials to wrap product containers or actual products has gained substantial popularity as a means, for instance, of providing tamper-resistant security, preserving freshness, and increasing the visual attractiveness of a product. Other advantages include the wrap's providing a surface onto which designs, logos, prices and the like may be stickered or printed without affecting any product within the wrap. In order to optimize the use of such wraps, it is desirable to wrap products or their containers very tightly. Tightly wrapped products tend to be easier to stack and display and tend to take up less room than would be expected of a loosely wrapped product. Moreover, in the case of a clear plastic shrink wrap, tight wrapping helps insure a clear view of the product or container within the wrap and thus helps increase visual appeal to consumers.

A problem with wraps of the type described above, is that they tend to be difficult to open, especially for children and the elderly. This is a particular problem with tightly wrapped products such as shrink wrapped products and static sealed wraps. It is not uncommon for a consumer to resort to some form of tool in attempting to gain access to a tightly wrapped product or container. It has been attempted to solve this problem by providing a tear strip in the wrap. However, such a tear strip may be expensive to produce and may break and prove unreliable in the hands of the consumer.

It is therefore an object of the present invention to provide a means for easy access to wrapped products and containers.

It is a further object to provide a means for easy access to wrapped products and containers which is inexpensive to produce, versatile and thoroughly reliable in use.

It is yet another object of the invention to provide an opening means for wrapped products and containers which also aids in sealing the wrap around the product or container prior to opening.

These and other objects will become apparent from a thorough reading of the instant specification and claims.

DESCRIPTION

The above and other objects are obtained by providing an easily accessible container comprising a sheet of wrapping material having interior and exterior sides, top and bottom ends, and top and bottom portions, respectively, between the ends; the sheet being wrapped around at least one product or product holder such that the top and bottom portions of the sheet overlap to form an overlap region having both an overlapping portion and an overlapped portion of the sheet; the container further comprising a pull tab adhesively affixed to the sheet in a manner such that an external pulling force exerted on the tab will be transmitted to the overlap region and will exert a force which pulls the overlapping portion of the sheet in a direction away from the overlapped portion of the sheet. It is preferred that the tab be adhesively bound to the overlapping portion of the sheet. In certain embodiments, the pull tab may be adhesively affixed to both the top and bottom portions of the sheet in a manner by which the tab helps bind the top and bottom portions together. In this embodiment, it is preferred and that the tab be free of adhesive wherever it crosses any end of the sheet.

The invention is elucidated further by the detailed description of certain preferred embodiments set forth below when read in conjunction with the drawings.

DETAILED DESCRIPTION OF CERTAIN PREFERRED EMBODIMENTS

FIG. 2 is the reverse side of the pull tab shown in FIG. 1.

FIG. 3 is the reverse side of a pull tab which may be used certain alternative embodiments of the invention.

FIG. 4 is an exaggerated cross-sectional view of the pull tab shown in FIG. 3.

FIG. 5 is a cross-sectional view of a wrap and pull tab assembled using the tab of FIGS. 3 and 4.

Figure 1:
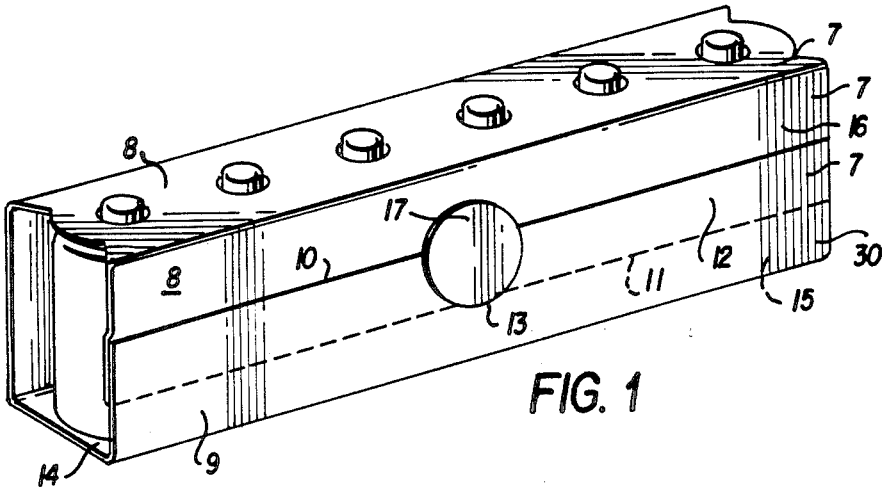
FIG. 1 is a plan view of one embodiment of the wrapped container of the instant invention.

In FIG. 1, battery holder 14 is shown wrapped in a sheet of clear plastic wrap 7. Sheet 7 has a top end 11 and a bottom end 10, as well as a top portion 8 (i.e. that portion of the wrap closer to the top end than to the bottom end when the sheet material is flat) which is overlapped by the bottom portion 9 (i.e. that portion of the sheet closer to the bottom end than to the top end when the sheet is flat) in overlap region 12. In certain preferred embodiments, top portion 8 is bound electrostatically or by other known means to bottom portion 9 in overlap region 12. Sheet 7 is preferably stretched tight such that its interior side 15 firmly contacts portions of battery holder 14. In overlap region 12, interior side 15 of bottom portion 9 preferably overlaps exterior side 16 of top portion 8 in a sealing manner. Pull tab 13 is adhesively affixed to exterior side 30 of bottom portion 9 such that when grasping element 17 of pull tab 13 is grasped and pulled away from holder 14, pull tab 13 transmits the pulling force to bottom portion 9 in overlap region 12 causing overlapping bottom portion 9 to be pulled in a direction away from overlapped top portion 8. A consumer's pulling of tab 13 may thus separate the top and bottom portions 8 and 9 of sheet 7 to create an opening through which holder 14 is accessible.

FIG. 2 shows the reverse side of pull tab 13 which is preferably coated in part by an adhesive 25 which is capable of forming a stronger bond between pull tab 13 and sheet 7 than is formed between upper portion 8 and lower portion 9 in overlap region 12. Tab 13 is preferably affixed to sheet 7 in such a manner that a substantial amount of adhesive 25 on its reverse side contacts exterior side 30 of bottom portion 9 in overlap region 12. It is desirable that an uncoated region 26 be retained in pull tab 13 to form grasping element 17. The lack of adhesive in this area facilitates ease of grasping. It is also desirable, though not necessary, that adhesive 25 not be present on any part of tab 13 which contacts any edge 10 or 11 of sheet 7. The lack of adhesive in this area enhances ease of opening.

FIGS. 3, 4 and 5 illustrate an alternative embodiment of the instant invention wherein pull tab 13 is coated with adhesive 25 in regions of tab 13 which are to contact both top portion 8 and bottom portion 9 of sheet 7. Optionally, the regions are separated by uncoated region 26. Pull tab 13 is preferably placed on a wrapped container in such a manner that a region of adhesive 25 contacts both exterior side 16 of top portion 8 and exterior side 30 of bottom portion 9. It is preferred, to enhance ease of opening, that uncoated region 26 of tab 13 cross bottom edge 10. It is desirable that another uncoated region 26 occur at that edge of tab 13 which is to form grasping element 17, which is preferably an edge of tab 13 farthest from bottom portion 9.

The sheet of wrapping material may be comprised of any material capable of providing a wrap for a product or product holder. Especially preferred are clear plastic shrink wraps, polyethylene, polypropylene, polyvinylchloride and the like. The wrap may be applied to, and sealed around, products and holders in a number of conventional ways known in the art, such as continuous overlap static sealing wherein those portions of the wrap which overlap adhere to one another electrostatically.

Any product or product holder for which wrapping is desired may be used in accordance with the instant invention. Holders may, for instance, be cardboard cartons for containing individual product units, but any container is appropriate. Likewise, products may be directly wrapped in accordance with the invention without prior enclosure in a container.

The pull tab may be comprised of any material of sufficient strength to retain its structural integrity when pulled by a consumer sufficiently to open the container in accordance with the invention. It is preferred that the material selected for the pull tab be responsive to the adhesive qualities of inexpensive adhesives usable with the wrap material. Cardboard or foil tabs are preferred and the size and shape of the tab may be varied as desired. The tab may be printed with opening instructions or other information if desired.

The adhesive used may be any of a large variety of known adhesive substances and should be selected from among those adhesives known to be effective for use with both the material which comprises the pull tab and the material which comprises the wrap. The adhesive should provide a seal between the pull tab and wrap which is stronger than any seal which is to be broken in accordance with the instant invention.

The words and descriptions of certain preferred embodiments used above are set forth by way of example only and are not intended to exclude the multitude of substantially equivalent embodiments which those of skill in the art will readily recognize to exist for the instant invention. All terms and descriptions are set forth by way of example and not by way of limitation and should not be interpreted to in any way limit the scope of the invention as defined by the following claims.

What is claimed is:

1. An easilly accessible container comprising:

(a) a sheet of wrapping material having interior and exterior sides, top and bottom ends, and top and bottom portions, respectively, between the ends; the sheet being wrapped around at least one product or product holder such that the top and bottom portion of the sheet overlap one another to form an overlap region comprising an overlapped portion of the sheet and an overlapping portion of the sheet, said top and bottom portions of the sheet being electrostatically bound in the overlap region to define a first bond;

(b) a pull tab adhesively affixed in part to the sheet to define a second bond, said pull tab comprising an adhesive-free grasping element; and (c) said second bond being stronger than said first bond whereby a single application of an external pulling force exerted on the grasping element is sufficient to separate said top and bottom portions of the sheet.

2. The container of claim 1 wherein portions of the interior side of the sheet contact the product or product holder.

3. The container of claim 1 wherein any portion of the pull tab which crosses an end of the sheet of material does not have adhesive applied thereto.

4. An easily accessible container comprising:

(a) a wrapping sheet comprised of material selected from the group consisting of polyethylene, polypropylene and polyvinylchloride; wherein the sheet has interior and exterior sides, top and bottom ends, and top and bottom portions respectively between the ends, and wherein the sheet is wrapped around at least one product or product holder such that the top and bottom portions overlap and are electrostatically sealed to one another to define a first bond and form an overlap region comprising an overlapped portion of the sheet and an overlapping portion;

(b) a foil pull tab adhesively affixed in part in the overlap region to the external side of the overlapping portion of the sheet to define a second bond, said tab comprises an adhesive-free grasping element; and (c) said second bond being stronger than said first bond whereby a single application of an external pulling force exerted on the grasping element is sufficient to separate said top and bottom portions of the sheet.

* * * * *

UNITED STATES PATENT AND TRADEMARK OFFICE

CERTIFICATE OF CORRECTION

PATENT NO. : 4,747,491

DATED : May 31, 1988

INVENTOR(S) : Thomas F. Ward

It is certified that error appears in the above-identified patent and that said Letters Patent is hereby corrected as shown below:

| Column | Line | |
|---|---|---|
| 2 | 1 | Delete "and". |
| 2 | 14 | After "used" insert --in--. |

Signed and Sealed this

Sixth Day of September, 1988

*Attest:*

DONALD J. QUIGG

*Attesting Officer*

*Commissioner of Patents and Trademarks*